US009958183B2

(12) United States Patent
Baker, IV et al.

(10) Patent No.: US 9,958,183 B2
(45) Date of Patent: May 1, 2018

(54) PORTABLE WATER HEATING MODULE

(71) Applicant: Armstrong Hot Water, Inc., Three Rivers, MI (US)

(72) Inventors: James B. Baker, IV, Three Rivers, MI (US); Matthew Dautle, Three Rivers, MI (US); Brad Allison, Vicksburg, MI (US)

(73) Assignee: ARMSTRONG HOT WATER, INC., Three Rivers, MI (US)

( * ) Notice: Subject to any disclaimer, the term of this patent is extended or adjusted under 35 U.S.C. 154(b) by 917 days.

(21) Appl. No.: 14/355,636

(22) PCT Filed: Nov. 1, 2012

(86) PCT No.: PCT/US2012/062991
§ 371 (c)(1),
(2) Date: May 1, 2014

(87) PCT Pub. No.: WO2013/067138
PCT Pub. Date: May 10, 2013

(65) Prior Publication Data

US 2014/0314399 A1 Oct. 23, 2014

Related U.S. Application Data

(60) Provisional application No. 61/554,361, filed on Nov. 1, 2011.

(51) Int. Cl.
*F24F 6/00* (2006.01)
*F24H 1/08* (2006.01)
(Continued)

(52) U.S. Cl.
CPC ..... *F24H 1/08* (2013.01); *F24H 1/101* (2013.01); *F24H 1/22* (2013.01); *F24H 1/287* (2013.01);
(Continued)

(58) Field of Classification Search
CPC ... F24H 1/38; F24H 1/287; F24H 1/44; F24H 9/1836; F24H 1/08; F24H 1/101; F24H 1/22; F24H 9/1818
(Continued)

(56) References Cited

U.S. PATENT DOCUMENTS 4,275,708 A 6/1981 Wood
4,337,893 A * 7/1982 Flanders ..... F24D 12/02 236/1 EB
(Continued)

FOREIGN PATENT DOCUMENTS

WO 1998/012485 A1 3/1998

OTHER PUBLICATIONS

International Preliminary Report on Patentability and the Written Opinion of the ISA, dated May 6, 2014.

*Primary Examiner* — Phuong Nguyen
(74) *Attorney, Agent, or Firm* — MacMillian, Sobanski & Todd, LLC

(57) ABSTRACT

A water heating pod includes at least one water heating module packaged within a container. The water heating module includes a plurality of water heating units in fluid communication with a basin. The basin is configured to support a first fluid communication between the water heating units and provide a second fluid isolation between the water heating units.

6 Claims, 6 Drawing Sheets

(51) Int. Cl.

| | |
|---|---|
| ***F24H 1/38*** | (2006.01) |
| ***F24H 1/28*** | (2006.01) |
| ***F24H 1/44*** | (2006.01) |
| ***F24H 9/18*** | (2006.01) |
| ***F24H 1/10*** | (2006.01) |
| ***F24H 1/22*** | (2006.01) |

(52) U.S. Cl.
CPC ..... *F24H 1/38* (2013.01); *F24H 1/44* (2013.01); *F24H 9/1818* (2013.01); *F24H 9/1836* (2013.01)

(58) Field of Classification Search
USPC ..... 126/360 A, 360 R, 355, 359, 350 B, 126/350 R, 361, 373, 375, 376, 307 R; 392/490, 491, 496, 465, 441, 449, 308; 219/439, 494, 482
See application file for complete search history.

(56) References Cited

U.S. PATENT DOCUMENTS

| | | | |
|---|---|---|---|
| 5,807,095 | A | 9/1998 | Gustafson et al. |
| 5,924,391 | A | 7/1999 | Baker, IV et al. |
| 5,967,137 | A | 10/1999 | Guillet et al. |
| 8,171,993 | B2 | 5/2012 | Hefley |
| 2013/0145996 | A1 | 6/2013 | Cooper et al. |

* cited by examiner

PORTABLE WATER HEATING MODULE

BACKGROUND OF THE INVENTION

This invention relates in general to water heaters and in particular to portable, large-scale water heating units to provide heated water in volumes suitable for commercial scale processes, such as for example oil production applications.

There is a need for efficiently heating high volumes of water for industrial applications, such as hydraulic fracturing ("fracing") in the oil and gas industries. Industrial processes, such as fracing, may require water heated to temperatures ranging from 100° F. to 140° F. In fracing, the heated water is injected under high pressure into wells to free up oil and natural gas that is trapped in shale formations. In some regions, such as the Bakken Shale region of North Dakota and Montana, a source of water is not available at or near the drilling site. As a result, large volumes of water must be transported to the site. Currently, the water is heated with inefficient mobile boilers on trucks at the drilling sites, using diesel fuel or propane gas. The heated water is stored in tanks on the site until it is used.

It would be desirable to produce heated water on-demand and in sufficient quantities to support industrial-scale processing activities. Conventional water heaters are normally scaled-up to a size sufficient to supply the hot water demand. These single, large scale units are usually too large to transport in a ready-to-use condition for water heating needs in the field. In addition, these units cannot be re-scaled in the event of a malfunction, and therefore, will cease to produce hot water. Thus, it would be desirable to provide an industrial water heating system that is portable, scalable, and containerized for use particularly in remote sites.

SUMMARY OF THE INVENTION

This invention relates to an industrial hot water heating system having multiple, modular water heating units that can be operated independently or together to meet hot water supply demands. This invention further relates to a unitizing structure that connects the multiple, modular heating units to provide the ability to match or optimize the units to improve the system's efficiency.

This invention further relates to a basin for pressure pulsation modulation of a plurality of water heating units. The basin comprises a basin outer section, at least one baffle plate, a plurality of base and a top cover. The at least one baffle plate is arranged within the basin outer section to form a plurality of chambers and also includes a spillway. The top cover is connected to the plurality of bases, each base extending into one of the plurality of chambers and defines an opening relative to a bottom of the basin outer section. The bases are configured to support a water heating unit. The spillway cooperates with the plurality of openings such that the bases are in communication with each other by way of a first fluid and the bases are isolated from fluid communication of a second fluid.

This invention further relates to a water heating module having a basin that supports at least two water heating units and provides communication of a first fluid between the water heating units and isolation of a second fluid between the water heating units.

This invention further relates to a water heating pod having a first water heating module and a second water heating module. The first and second water heating modules each have a basin that supports a plurality of water heating units. Each basin has baffles that define a plurality of chambers where each chamber is associated with one of the plurality of water heating units. Each chamber is in fluid communication with a base, and each base defines at least one opening and supports one of the plurality of water heater units. The first and second water heating modules are housed within a container. The container has a length and a width sufficient for transport over roadways.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figures 1, 2:
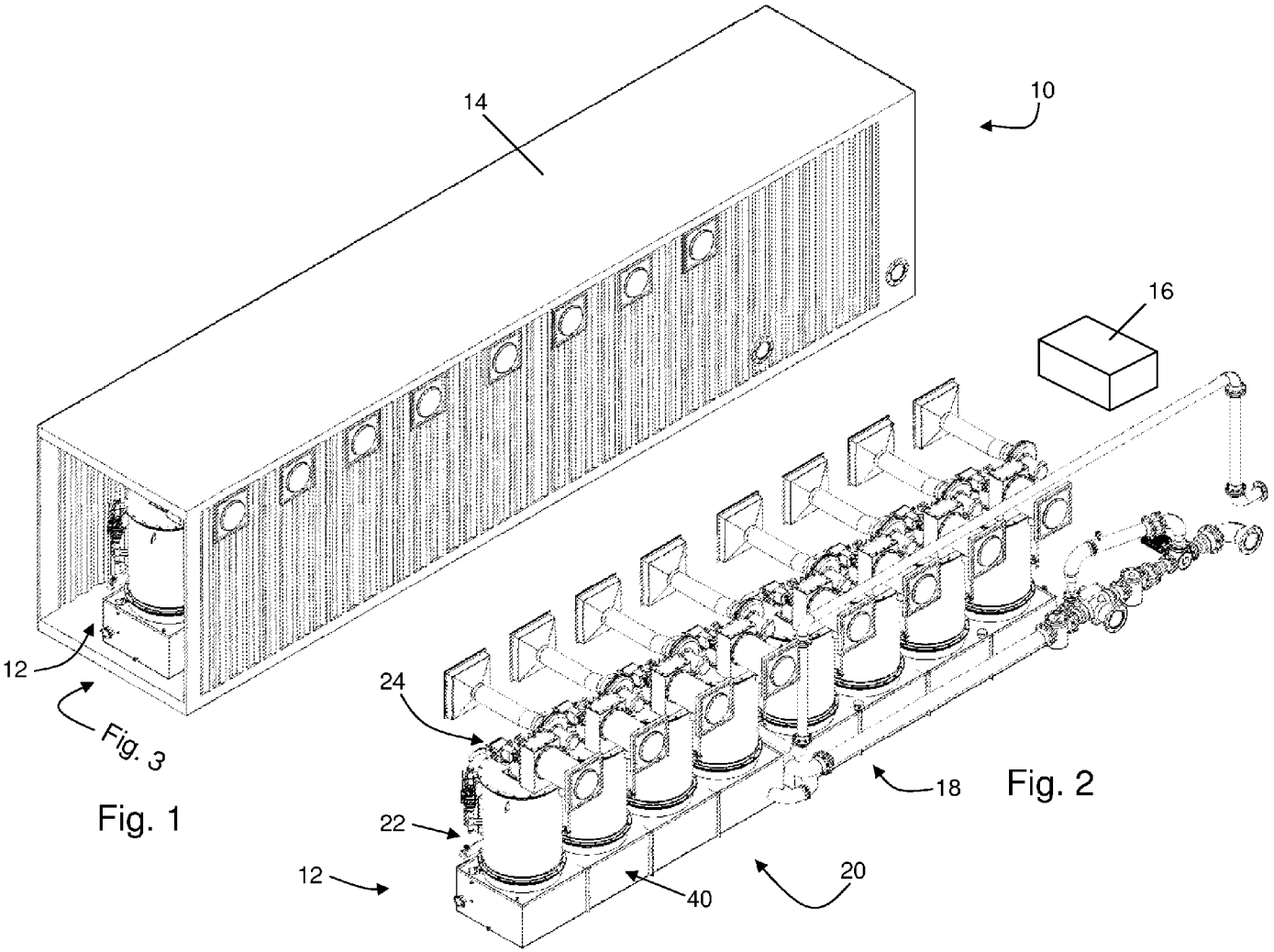
FIG. 1 is a perspective view of a water heating pod having a water heating module within a container.
FIG. 2 is a perspective view of an embodiment of the water heating module of FIG. 1.
Figure 3:
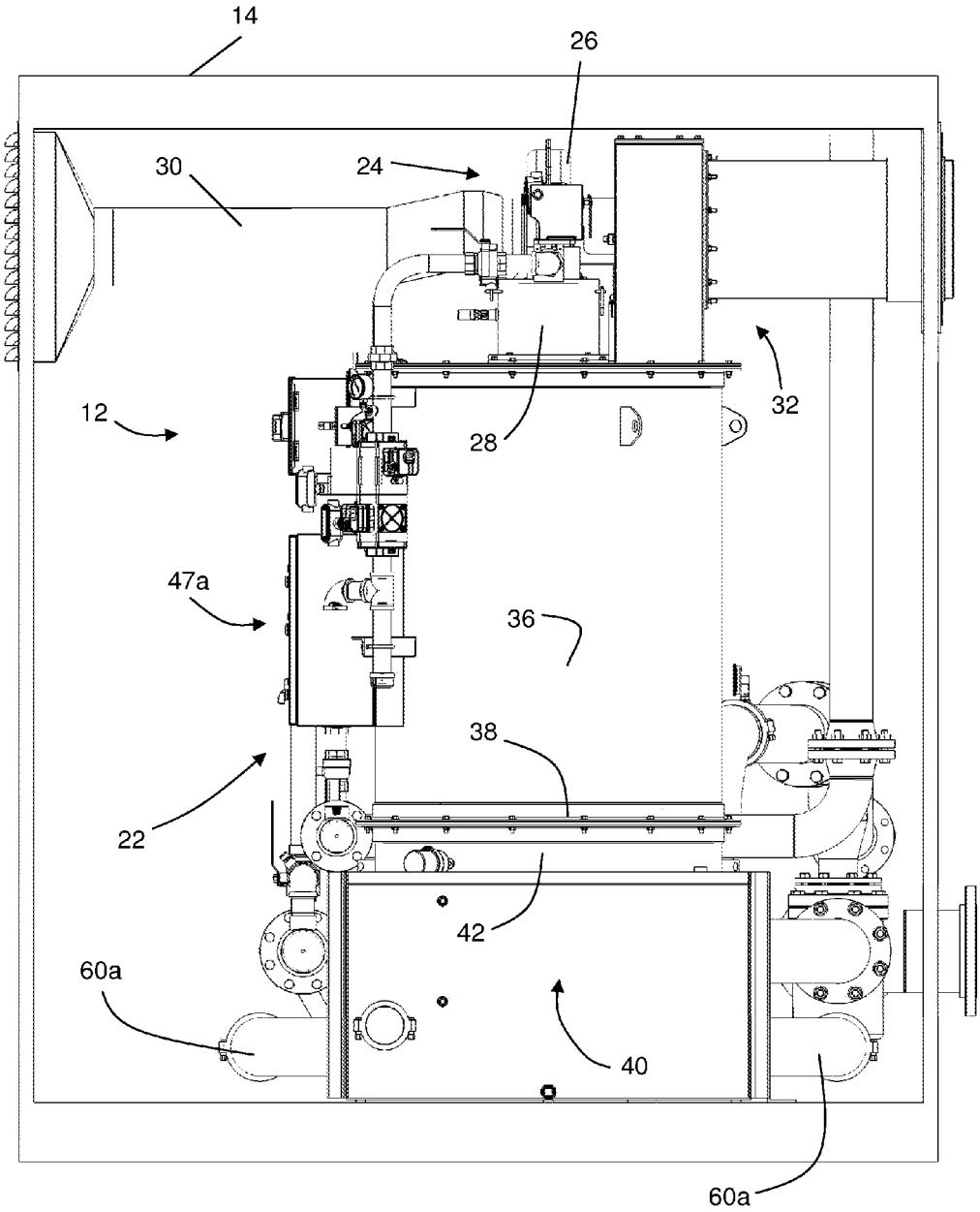
FIG. 3 is an end view of the water heating pod of FIG. 1.

Referring now to the drawings, there is illustrated in FIGS. 1 and 3 a portable, modular hot water heating unit, also referred to as a "water heating pod" or "pod", shown generally at 10. The pod 10 includes an assembled, multiple heater, water heating module 12 within a container 14. In one embodiment, the container is an ISO Shipping Container but may be any container suited for the purposes described herein. A mobile power unit 16, as shown in FIG. 2, such as an electrical power generator, may be provided to run various heater control units, work lights, ventilation units, and the like. As shown in FIG. 2, the assembled, multiple heater, water heating module 12 is illustrated having two heater sub-modules 18, 20. Each of the heater sub-modules 18, 20 includes a plurality of water heating units 22. The plurality of water heating units 22 in each of the sub-modules 18, 20 are illustrated as 4 units, though more or fewer, or a different number for each sub-module may be used if desired. In one embodiment, the water heating units 22 are gas-fired hot water heaters, similar to the heating unit described in U.S. Pat. No. 5,924,391, the disclosure of which is incorporated by reference in its entirety. Alternatively, other types of water heaters, such as for example, direct contact heaters, submerged combustion heaters, and the like may be used. Additionally, different types of combustion fuel powered, water heating units may be combined into sub-modules, if desired.

Each of the water heating units 22 includes a gas-fired combustion unit 24 having a blower 26, a burner 28, an intake 30 connected to the blower, and an exhaust 32. The fuel used in the combustion unit 24 may be any combustible fuel, and preferably a gaseous combustible such as natural gas, propane, well gas, and the like, though liquid combustion fuels may be used. The burner 28 is connected to one end of a central heat tube 34 that carries the combustion flame through a heat tank 36 that transfers combustion heat to the water flowing through the tank 36. The heat tank 36 may contain loose pall rings (not shown), or any other medium, that increase the available surface area of the tank and permit water to form a thin film that is more easily and quickly heated. The heat tank 36 is connected to a lower grate 38 that permits water to flow through the heat tank 36 and collect in the basin assembly 40. The lower grate 38 also supports and contains the pall rings within the heat tank 36. The heat tank 36 and lower grate 38 are supported by a base 42 having at least one opening 44. The opening 44, as shown in FIG. 9, are four equally spaced openings disposed around the base 42, though the number, relative orientation, and configuration of openings 44 may be different. The base 42 and the openings 44 act as a first baffle that controls the flow of water out of and into the base 42 from adjacent heater units 22 mounted in the same heater sub-module 18.

Figure 4:
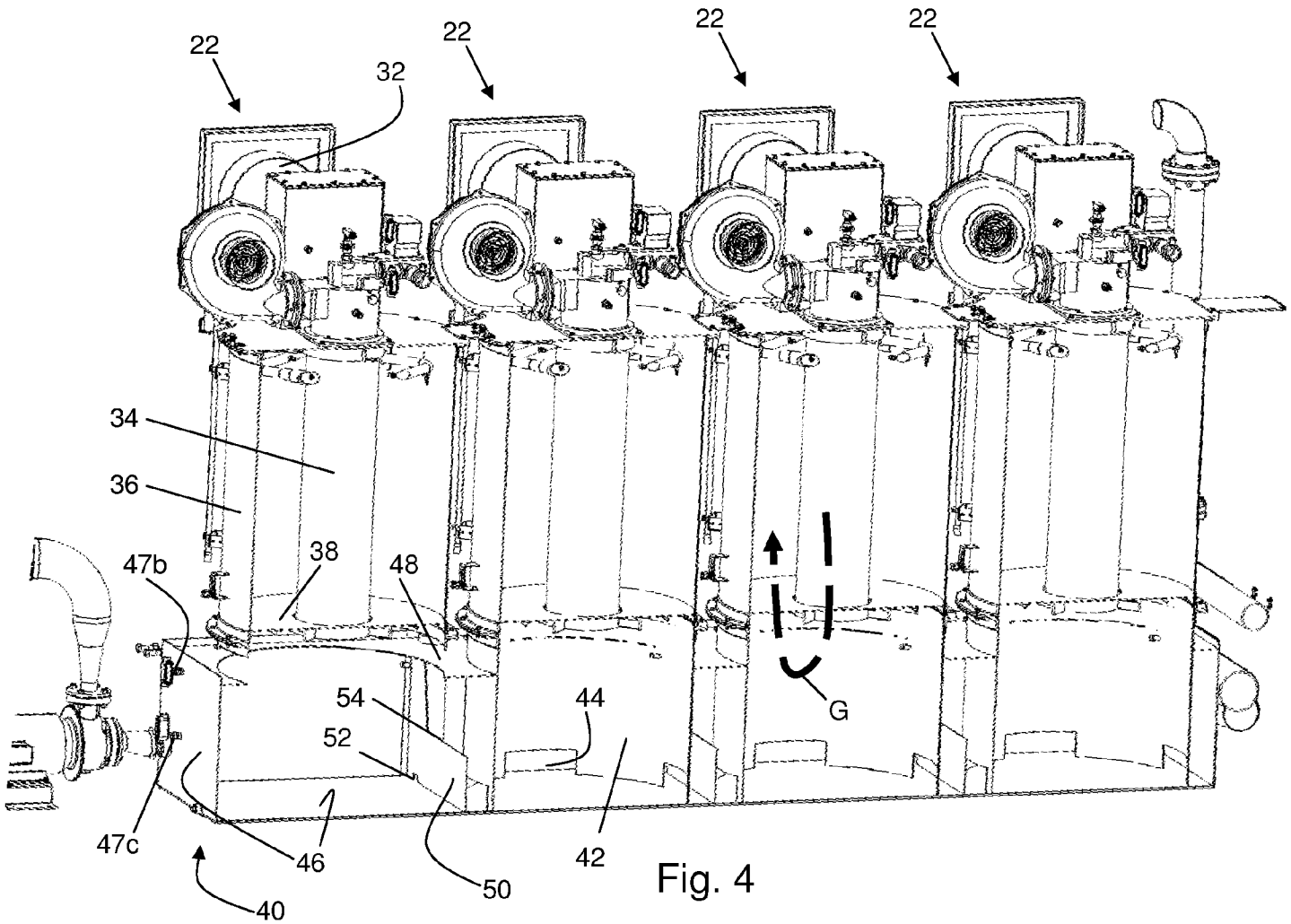
FIG. 4 is a perspective view, in cross section, of a sub-module section of the water heating module of FIG. 2.
Figure 5:
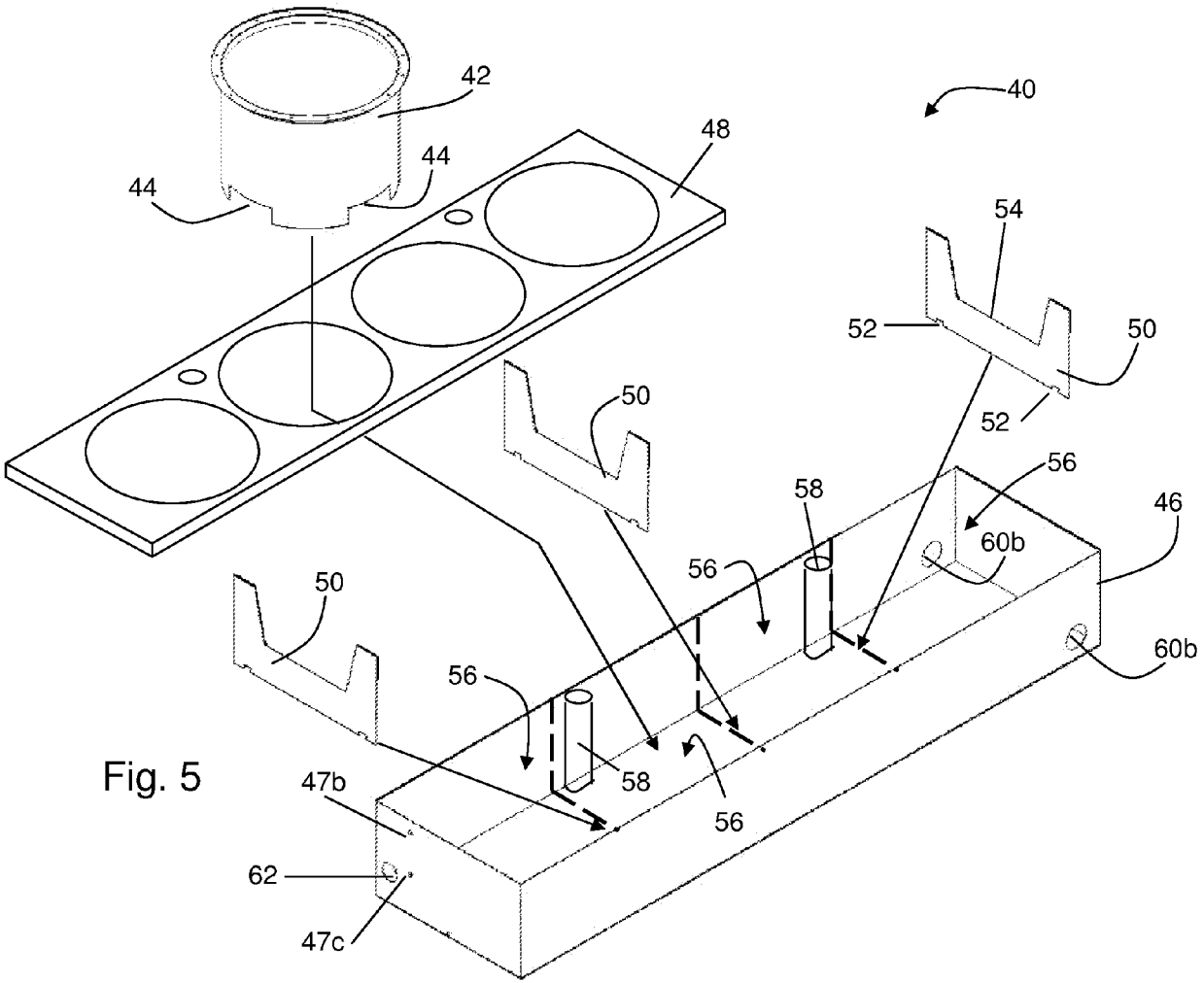
FIG. 5 is an exploded view of a basin assembly for a water heating sub-module, similar to the sub-module of FIG. 4

Referring to FIGS. 4 and 5, the base 42 extends to the bottom of a basin outer section 46 of the basin 40. The basin outer section 46 forms the outer boundaries of the basin 40 and establishes the volume of heated water held for release by the sub-modules 18, 20. The flow of water from the basin 40 is typically as produced, though water may accumulate in the basin 40 and may be released in larger quantities. The base 42 supports the weight of the heater units 22 and transfers the weight to a common surface (i.e., the bottom of the basin outer section 46) that is well supported, such as by the ground or the container 14. Alternatively, the weight of the heater units 22 may be supported by a top cover 48, through which the base 42 extends, or both. Additionally, other means for supporting the weight of the heater units 22 can be used. The basin 40 further includes baffle plates 50. The baffle plates 50 may include equalization ports 52 formed at or near the bottom surface. The equalization ports 52 provide a static or low level dynamic distribution of water in the basin 40. In one embodiment, the equalizations ports 52 may provide a generally lower water communication level than the openings 44. In another embodiment, the equalization ports 52 may provide a higher fluid communication level than the openings 44. The baffle plates 50 include a spillway 54 which limits a maximum amount of water held within each chamber of the basin 40 under the individual heater units 22. In one embodiment, the spillway 54 is positioned higher than the base openings 44 to retain a sufficient water level to form and maintain a hydraulic seal within the basin 40. As shown in FIG. 4, the hydraulic seal, formed between the baffle plate 50 and the openings 44, forces combustion gases G to travel up through the bed of pall rings in the heater units 22 to capture additional heat, thereby boosting efficiency. The hydraulic seal is maintained between heater units 22 as the water level rises above the spillway 54. The hydraulic seal also prevents a combustion gas and air pressure exchange between heater units that may negatively affect combustion and thermal efficiency.

As shown in FIG. 3, each of the water heating units 22 includes a control panel 47*a* that permits individual control of each unit 22. Alternatively, the control panel 47*a* may be a single panel with cascading control over the operation of each individual heater unit 22. The control panel 47*a* may include adjustability features, for example, to tune or optimize fuel gas flow, air flow, and water flow and may also include safety feedback circuits. The module 12, as shown in FIG. 4, may also include safety switches, such as a high water level safety switch 47*b* and a low water level safety switch 47*c*. In one embodiment, a preferred water level within the basin 40 is generally midway between the high and low water level switches, though such is not required. The ability to control the individual heating units 22 permits optimization of output efficiency by controlling gas pressure input pulses, caused by both the steady state pressure component of the fuel input and the pulsed pressure component of the blower 26, caused by for example impeller vane forces introduced to the air supply. As will be explained below, the basin assembly 40 permits these pulsations, attributable to the pressure differentials within the individual heater units 22, to be dissipated over the entire sub-modules 18, 20 or the entire module 12. Thus, the ability to tune the individual heater units 22 to maximize heated water output and minimize pulsations when mounted in the sub-module 18, 20 is positively affected by the ability of the basin 40 to minimize the pressure pulsations that influence the water level of adjacent heater units 22 and the thermal transfer within each unit 22.

Referring now to FIG. 5, an exploded view of the basin 40 is illustrated. The basin outer section 46 is illustrated as a rectangular section. It should be understood that the shape of the basin outer section 46 may be any shape desired. The rectangular shaped embodiment of the basin outer section 46 is dimensioned and sized to be well suited for the intended thermal and water delivery capacity, which may be in the range of 11-13 million Btu/hr and 250 gallons per minute with a 100° F. temperature rise. By combining two end-to-end assembled sub-modules 18 and 20, as shown in FIG. 2, the module 12 will fit into the container 14, illustrated in FIG. 1 as a standard 40 foot ISO Shipping Container and be capable of 22-26 million Btu/hr and 500 GPM at a 100° F. temperature rise. The basin outer section 46 supports the plurality of baffle plates 50 that are shown arranged in equally spaced positions within the outer section 46. The baffle plates 50 define chambers 56 that contain water to enable a water hydraulic seal between openings 44 of the various heater units 22 and support the bases 42. The top cover 48 contains the baffle plates 50 and position and secure the bases 42. Overflow tubes 58 extend between the interior of the basin outer section 46 through the top cover 48. The overflow tubes 58 act as vents to atmosphere to prevent pressure build-up and provide a failsafe water level that prevents the heater units 22 from filling with water in the event of failure of the output pump and high water level safety switch 47*b*. Multiple sub-modules, such as sub-modules 18 and 20 can be connected together by submerged junction tubes 60*a* at junction ports 60*b* formed into the basin outer section 46. One or more water outlets 62 permit coupling of one or more output pumps to supply water to the end use.

Figure 6:
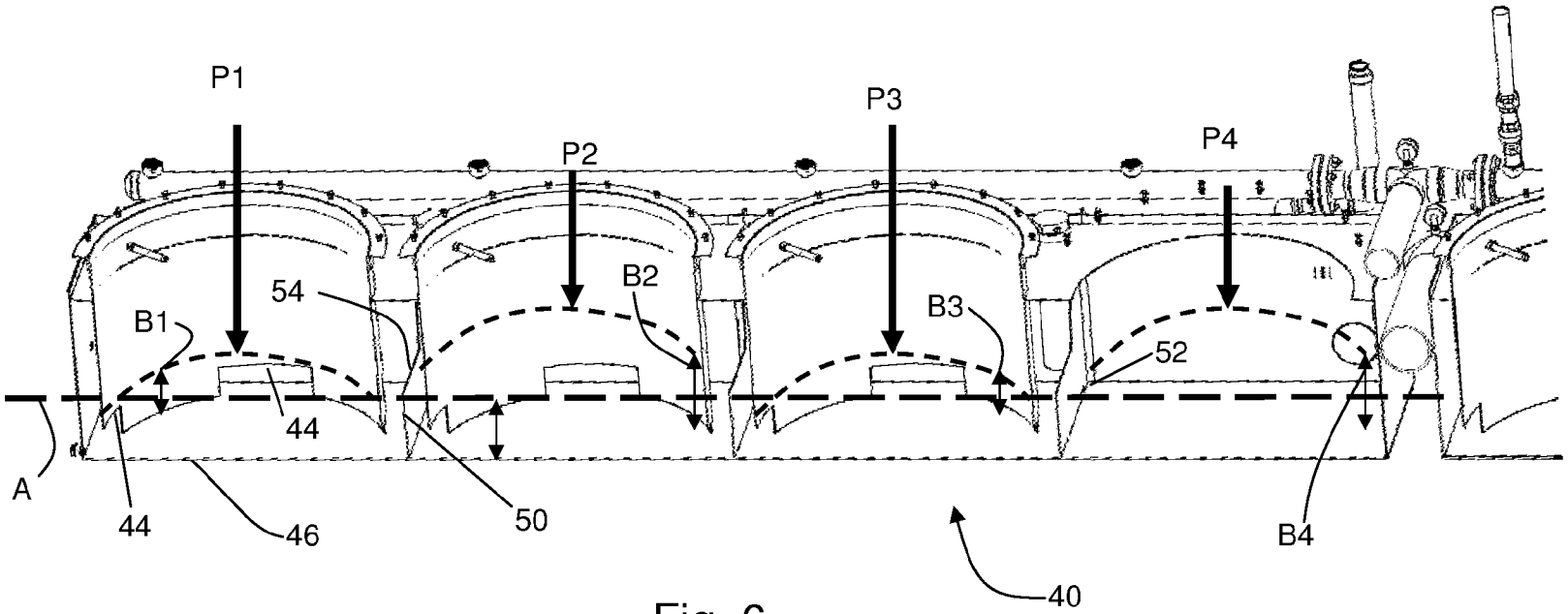
FIG. 6 is a perspective view, in cross section of the basin assembly of FIG. 5

Referring now to FIG. 6, there is illustrated a cross section of the basin 40 showing a spillway water level A, that is higher than the water level of the base openings 44 to establish the hydraulic seal, as described above. Different magnitudes of pressure pulses P1, P2, P3, and P4, and an associated water level B1, B2, B3, and B4 in each base 42 are schematically illustrated prior to tuning the heater units 22. The water levels B1-4 are inversely proportional to the pressure pulses P1-4 that are generated by the combustion gas pressure and pulsed from the blower 26. As water is supplied to each heater unit 22, the water levels build within each base 42. The target water flow through each heater unit 22 is intended to be adjusted to be generally equal in all units, though such may not be the case, particularly during initial start up. The gaseous fuel supply at start up may also be different for each heater unit 22, along with the combustion air flow. Prior to tuning, the combustion gas pressures P1-4 may be different causing different pressures within each base 42 to temporarily generate different water levels within the base 42 that impact the overall heater unit thermal efficiency and water delivery capability. After the system has been tuned, i.e., a balancing adjustment of the various heater unit controls to bring the system into a more optimal running condition, re-tuning may be necessary, particularly if one or more heater units 22 are dropped from service.

Figure 7:
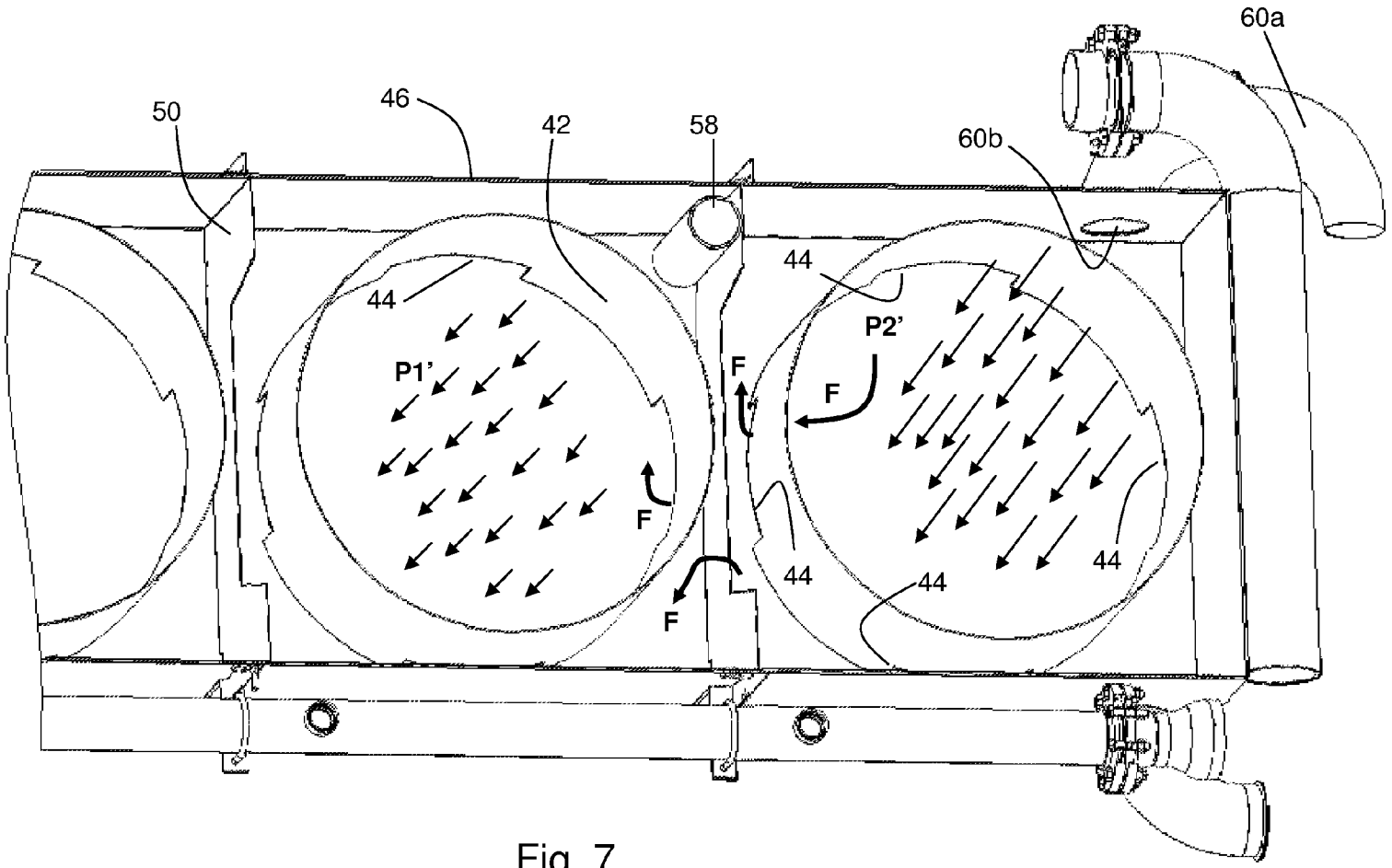
FIG. 7 is a perspective, cross sectional top view of a portion of the basin assembly of FIG. 6.

Water is characterized as an "incompressible" fluid and merely connecting the conventional water heater units together by way of piping, without the basins 40, creates significant resistance to flow between units. This resistance to flow may occur because of the incompressible nature of water, resistance of the interconnecting piping, and pulsations of incoming combustion gas/air. The pressure pulses, without the openings 44 and baffles 50, would force water levels to change, but with a lagging reaction to the pressure pulses. This creates an amplified pulsation that can be exacerbated if the pulsation frequencies approach a system resonance frequency. Thus, the baffles 50 and openings 44 act to isolate each heater unit's combustion profile (gas/air flow, pulse frequency, etc.) with a hydraulic seal, yet permit the individual pressure pulses, such as pressure pulses P1' and P2' illustrated in FIG. 7, to be relieved by permitting free flow of water between the bases 42 within the basins 40. Thus, by smoothing out the pressure back ups between heater units that cause thermal and fluid flow inefficiencies, the heater units can be adjusted for individual optimal efficiency and thereby maximize the overall module output efficiency. As also shown in FIG. 7, the water flow F between bases 42 is illustrated.

As discussed briefly above, the portability of the Pod 10 is made possible by the ability to package a large thermal capacity water heating system in a small footprint and maintain a small head height. Conventional methods of supplying hot water for large scale applications, such as fracing, typically use one large unit which is sized for the maximum water requirement. Alternatively, one or more smaller units may be used in conjunction with heated storage tanks that accumulate any excess hot water output to meet peak demands. These conventional methods have proven to be expensive, time consuming, and cumbersome to operate, particularly where a building or other shelter needs to be built to house the system. The Pod 10 is self contained with ready connections for fuel and water. Since the container 14, in one embodiment is an ISO Shipping Container, the Pod 10 may be shipped by truck, rail, or boat to any intended location. In one embodiment, the container 14 is generally in a range of approximately 20 feet to approximately 40 feet in length and within a roadway width requirement, such as in a range of a 100-105 inch width requirement sufficient for transport over roadways. Once delivered, the Pod 10 is ready to be connected and operated. The self contained nature of the Pod 10 protects the module 12 from the elements and provides sufficient space to adjust or service the individual heater units 22, while permitting continued operation of the remaining units. The container 14 may alternatively be configured as a semi-truck trailer having wheels and towing structures, if so desired.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A water heating module having a basin that supports at least two water heating units and provides communication of a first fluid that is water between the water heating units and isolation of a second fluid that is a combustion gas between the water heating units, the basin including at least one baffle plate that divides the basin into a plurality of chambers, each chamber configured to form a hydraulic seal with water between the remaining plurality of chambers, the hydraulic seal containing the combustion gas within the water heater unit generating the combustion gas;

the baffle includes at least one equalization port that provides communication of water between the plurality of chambers;

the basin includes a bottom and further includes a base that extends into each chamber and supports one water heating unit, the base having at least a portion that is spaced apart from the basin bottom to form an opening, the opening configured to permit water flow from the water heating unit to the basin; and the baffle includes a spillway that permits communication of water between the plurality of chambers, the equalization port providing a water communication level that is lower than an opening water communication level, and a spillway water communication level that is higher than the opening water communication level.

2. The water heating module of claim 1 wherein water flows through at least one of the water heating units and the combustion gas flows through the at least one water heating unit in a first direction to transfer heat into the water, and the baffle forms the hydraulic water seal between adjacent chambers such that the combustion gas flows back through the water heater unit in a second direction such that additional heat is transferred to the water.

3. The water heating module of claim 2 wherein the water heating unit includes a heat tank and a central heat tube, the central heat tube being configured to permit combustion gas flow therethrough in the first direction and the hydraulic seal diverting the combustion gas flow through the heat tank in the second direction which is generally opposite of the first direction.

4. The water heating module of claim 2 wherein the combustion gas includes a pressure pulsation characteristic that acts on the hydraulic seal such that water communicates between the chambers in response to the pressure pulsation characteristic.

5. The water heating module of claim 4 wherein the at least two water heating units are each supported on a base that extends into an associated one the plurality of chambers, the base forming at least one opening with the basin that is sealed from the combustion gas by the hydraulic seal, each of the water heating units being configured to produce different pressure pulsation characteristics and the water level in the corresponding base is adjusted by varying the pressure pulsation characteristic of the water heating unit.

6. The water heating module of claim 5 wherein each of the at least two water heating units are adjustable to vary the pressure pulsation characteristic such that the water level within each of the bases is generally equalized.

* * * * *